US006139054A

United States Patent [19]

Blomouist

[11] Patent Number: 6,139,054

[45] Date of Patent: Oct. 31, 2000

[54] REDUCED SMOKE GAS GENERANT WITH IMPROVED TEMPERATURE STABILITY

[75] Inventor: Harold R. Blomouist, Gilbert, Ariz.

[73] Assignee: TRW Inc., Lyndhurst, Ohio

[21] Appl. No.: 09/203,113

[22] Filed: Dec. 1, 1998

[51] Int. Cl.[7] ..... B60R 21/28; C06B 45/10; C06B 31/28; C06B 25/34

[52] U.S. Cl. ..... 280/741; 149/19.1; 149/46; 149/61; 149/76; 149/77; 149/92

[58] Field of Search ..... 280/735, 741; 149/19.1, 46, 61, 76, 77, 92; 564/107

[56] References Cited

U.S. PATENT DOCUMENTS

| | | | |
|---|---|---|---|
| 3,943,209 | 3/1976 | LoPresti et al. | 264/3 |
| 5,034,072 | 7/1991 | Becuwe | 149/19.4 |
| 5,451,277 | 9/1995 | Katzakian et al. | 149/19.92 |
| 5,872,329 | 2/1999 | Burns et al. | 149/36 |
| 5,898,126 | 4/1999 | Yoshida | 149/46 |
| 5,936,195 | 8/1999 | Wheatley | 149/19.91 |

*Primary Examiner*—Charles T. Jordan
*Assistant Examiner*—Aileen J. Baker
*Attorney, Agent, or Firm*—Tarolli, Sundheim, Covell, Tummino & Szabo L.L.P.

[57] ABSTRACT

An apparatus (10) comprises an inflatable vehicle occupant protection device (20) and a gas generating composition (16) which when ignited produces gas to inflate the inflatable vehicle occupant protection device (20). The gas generating composition (16) comprises an oxidizer and a fuel component. The oxidizer is an inorganic salt. The fuel component is a keto derivative of RDX or HMX, more specifically a fuel component selected from the group consisting of 2-oxo-1,3,5-trinitro-1,3,5-triazacyclohexane (keto-RDX), 2,4-dioxo-1,3,5-trinitro-1,3,5-triazacyclohexane (di-keto-RDX), 2,4,6-trioxo-1,3,5-trinitro-1,3,5-triazacyclohexane (tri-keto-RDX), 2-oxo-1,3,5,7-tetranitro-1,3,5,7-tetrazacyclooctane (keto-HMX), 2,4-dioxo-1,3,5,7-tetranitro-1,3,5,7-tetracyclooctane (di-keto-HMX), 2,4,6-trioxo-1,3,5,7-tetranitro-1,3,5,7-tetracyclooctane (tri-keto-HMX), and 2,4,6,8-tetraoxo-1,3,5,7-tetranitro-1,3,5,7-tetracyclooctane (tetra-keto-HMX).

9 Claims, 2 Drawing Sheets

REDUCED SMOKE GAS GENERANT WITH IMPROVED TEMPERATURE STABILITY

FIELD OF THE INVENTION

The present invention relates to an apparatus comprising an inflatable vehicle occupant protection device, and particularly relates to a gas generating composition for providing inflation gas for inflating an inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

It is desirable that the gas generating material for inflating an inflatable vehicle occupant protection device meet a number of technical requirements. For instance, the gas generated by combustion of the gas generating material should be substantially free of toxic materials. It should also be essentially smoke-free and should have a low water content. The gas generating material must be chemically and physically stable over a wide temperature range, and should have ignition and combustion characteristics suitable for use in a vehicle occupant protection device.

High energy organic compounds such as 1,3,5-trinitro-1,3,5-triazacyclohexane (RDX) and 1,3,5,7-tetranitro-1,3,5,7-tetracyclooctane (HMX) have been proposed for use in rockets and gun powder. U.S. Pat. No. 3,943,209 discloses a rocket or gunpowder propellant formulation that comprises HMX and ammonium nitrate (AN). The advantage of ammonium nitrate in the formulation is that the gas effluent from combustion of the formulation is smokeless. However, the ammonium nitrate is present in the formulation in a relative large percent. Ammonium nitrate can undergo phase changes with changes in temperature. A vehicle occupant protection device may be exposed to wide temperature changes, and thus any body of gas generating material in a vehicle occupant protection device which comprises a large amount of ammonium nitrate may physically degrade over time. Also, compositions containing large amounts of ammonium nitrate may be difficult to ignite, and/or may not sustain combustion at low ambient temperature.

Perchlorates such as potassium perchlorate ($KClO_4$) and ammonium perchlorate ($NH_4ClO_4$) are good oxidizers. In combination with an organic fuel component, they burn rapidly. However, they can produce hydrogen chloride (HCl), in the form of a mist, or potassium chloride (KCl), in the form of a white smoke. Both products are undesirable, in large quantities, in a combustion gas product for inflating a vehicle occupant protection device.

SUMMARY OF THE INVENTION

The present invention is an apparatus which comprises an inflatable vehicle occupant protection device and a gas generating composition which when ignited produces gas to inflate the inflatable vehicle occupant protection device. The gas generating composition comprises an oxidizer and a fuel component. The oxidizer is an inorganic salt. The fuel component is a keto-derivative of RDX (1,3,5-trinitro-1,3,5-triazacyclohexane) or HMX (1,3,5,7-tetranitro-1,3,5,7-tetracyclooctane) in which at least one methylene ($CH_2$) group in the RDX or HMX molecule is replaced by a keto (C═O) group. Specifically the fuel component is a keto, di-keto, tri-keto, tetra-keto derivative of RDX or HMX, or still more specifically the fuel component is selected from the group consisting of 2-oxo-1,3,5-trinitro-1,3,5-triazacyclohexane (keto-RDX), 2,4-dioxo-1,3,5-trinitro-1,3,5-triazacyclohexane (di-keto-RDX), 2,4,6-trioxo-1,3,5-trinitro-1,3,5-triazacyclohexane (tri-keto-RDX), 2-oxo-1,3,5,7-tetranitro-1,3,5,7-tetrazacyclooctane (keto-HMX), 2,4-dioxo-1,3,5,7-tetranitro-1,3,5,7-tetracyclooctane (di-keto-HMX), 2,4,6-trioxo-1,3,5,7-tetranitro-1,3,5,7-tetracyclooctane (tri-keto-HMX), and 2,4,6,8-tetraoxo-1,3,5,7-tetranitro-1,3,5,7-tetracyclooctane (tetra-keto-HMX).

Preferred inorganic salts are ammonium nitrate (AN), preferably phase stabilized ammonium nitrate, potassium nitrate (KN), sodium nitrate (NaN), potassium perchlorate (KP), or ammonium perchlorate (AP), and mixtures thereof.

It was discovered in accordance with the present invention, that by replacing at least two hydrogen atoms in the RDX or HMX molecule with an oxygen atom, the oxygen balance in the combustion reaction was substantially increased. The increase in the oxygen balance is due to the presence of the added oxygen atom in the molecule and also due to the reduced consumption of oxygen by the presence of fewer hydrogen atoms in the molecule. The improvement in oxygen balance was found to reduce the amount of inorganic salt required for complete combustion of the fuel component to the surprising extent that problems associated with use of an inorganic salt were overcome.

BRIEF DESCRIPTION OF THE DRAWINGS

The foregoing and other features of the invention will become more apparent to one skilled in the art upon consideration of the following description of the invention and the accompanying drawings in which.

DESCRIPTION OF PREFERRED EMBODIMENTS

Figure 1:
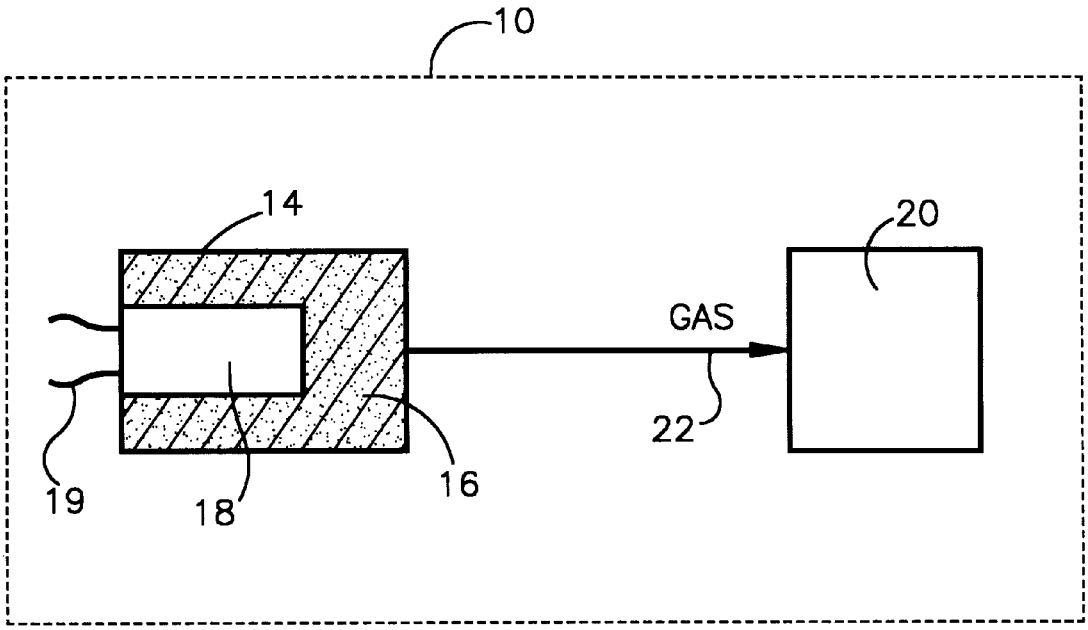
FIG. 1 is a schematic illustration of an apparatus embodying the present invention.

Referring to the FIG. 1, an apparatus 10 embodying the present invention comprises an inflator 14. The inflator 14 contains a gas generating composition 16. The gas generating composition 16 is ignited by an igniter 18 operatively associated with the gas generating composition 16. Electric leads 19 convey current to the igniter 18 as part of an electric circuit that includes a sensor (not shown) which is responsive to vehicle deceleration above a predetermined threshold. The apparatus 10 also comprises a vehicle occupant protection device 20. A gas flow means 22 conveys gas, which is generated by combustion of the gas generating composition 16 in the inflator 14, to the vehicle occupant protection device 20.

A preferred vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners, and/or inflatable side curtains.

Figure 2:
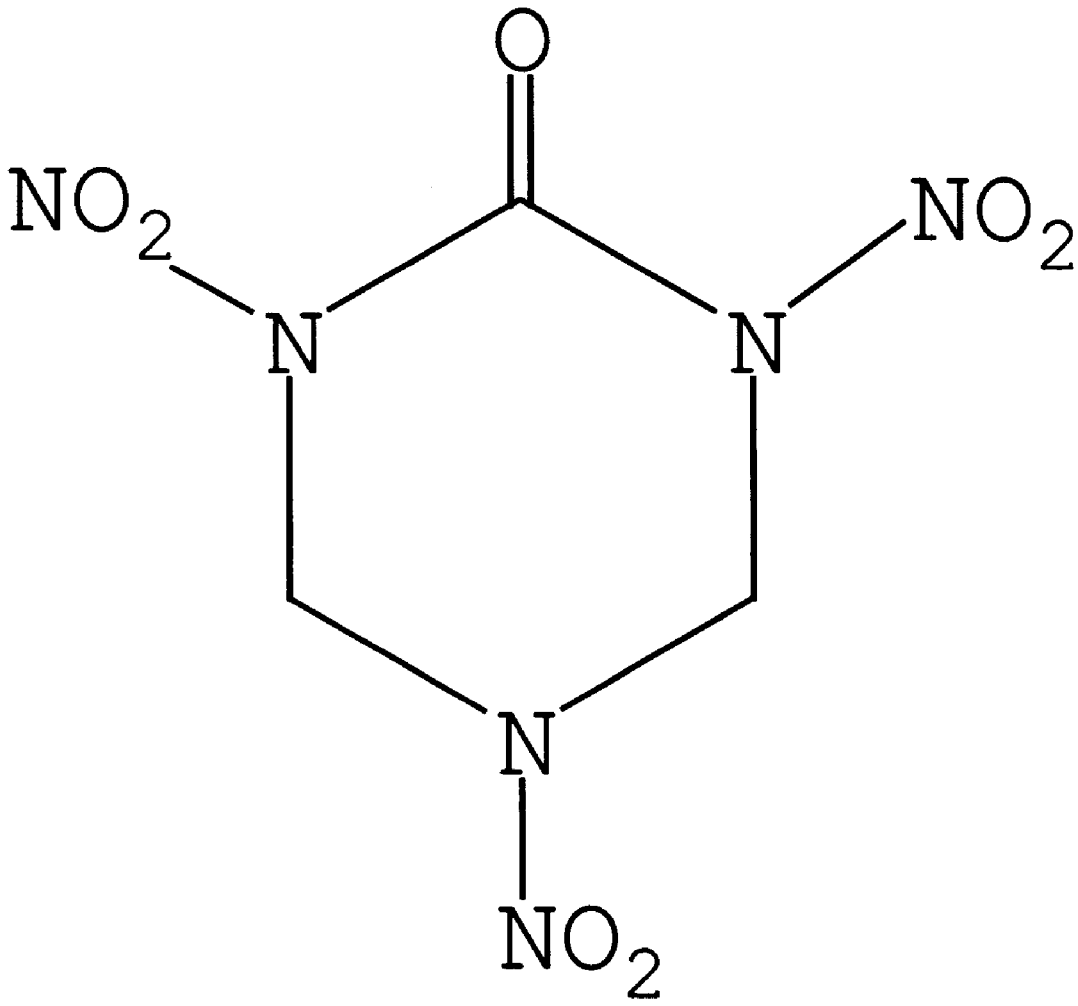
FIG. 2 is a drawing showing the structure of keto-RDX.

The gas generating composition 16 of the present invention comprises a fuel component. The fuel component is a keto-derivative of 1,3,5-trinnitro-1,3,5-triazacyclohexane (RDX) or 1,3,5,7-tetranitro-1,3,5,7-tetrazacyclooctane (HMX) in which, as shown in FIG. 2, at least one methylene ($CH_2$) group in the fuel component molecule (RDX in FIG. 2) is replaced by the keto (C=O) group; specifically a keto, di-keto, tri-keto, or tetra-keto derivative of 1,3,5-trinitro-1,3,5-triazacyclohexane (RDX) or of 1,3,5,7-tetranitro-1,3,5,7-tetrazacyclooctane (HMX). More specifically the fuel component is selected from the group consisting of 2-oxo-1,3,5-trinitro-1,3,5-triazacyclohexane (keto-RDX), 2,4-dioxo-1,3,5-trinitro-1,3,5-triazacyclohexane (di-keto-RDX), 2,4,6-trioxo-1,3,5-trinitro-1,3,5-triazacyclohexane (tri-keto-RDX), 2-oxo-1,3,5,7-tetranitro-1,3,5,7-tetrazacyclooctane (keto-HMX), 2,4-dioxo-1,3,5,7-tetranitro-1,3,5,7-tetracyclooctane (di-keto-HMX), 2,4,6-trioxo-1,3,5,7-tetranitro-1,3,5,7-tetracyclooctane (tri-keto-HMX), and 2,4,6,8-tetraoxo-1,3,5,7-tetranitro-1,3,5,7-tetracyclooctane (tetra-keto-HMX).

Keto-RDX is obtained in two steps starting with urea, formalin, and tert-butylamine. The reaction scheme of this process is as follows:

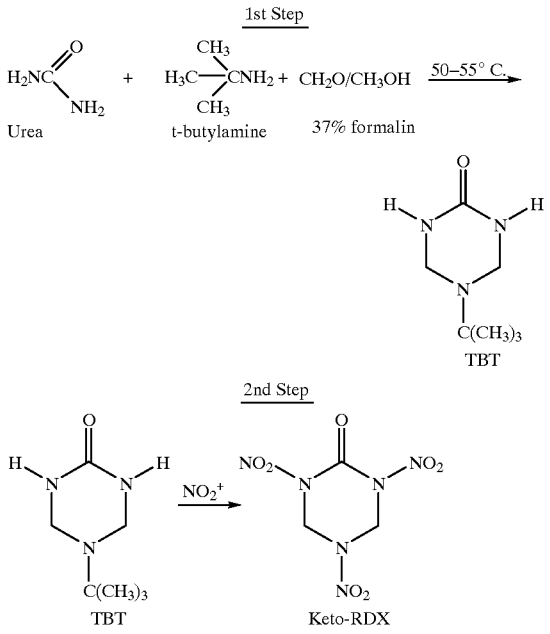

In the first step, urea is reacted with a 37% fomalin solution and tert-butylamine at about 53° C. to form 4-tert-butyl-2-oxo-1,3,5-hexahydrotriazine (TBT) with a yield of 5 about 52% by molecular weight based on the molecular weight of the substituents. The second step consists of nitrating the TBT to form keto-RDX. This may be accomplished by reacting the TBT with a solution of trifluoroacetic anhydride and 20% $N_2O_5$ in $HNO_3$ at about 40° C. to form keto-RDX with a yield of about 40% by molecular weight based on the molecular weight of TBT. Alternatively, the TBT may be reacted with a solution of acetic anhydride and 20% $N_2O_5$ in $HNO_3$ at about 45° C. to form keto-RDX in a yield of about 23% by molecular weight based on the molecular weight of TBT.

Keto-RDX has a molecular weight of 236.1 and a melting point of about 180–181° C. It is chemically stable and has a burn rate similar to that of HMX. The burn rate without oxidizer of keto-RDX is 7,000 m/s versus 9,000 m/s for HMX without oxidizer. Furthermore, keto-RDX has an impact sensitivity of about 15 cm and a friction sensitivity of 4.2 kg, which is within criteria for manufacturing and transporting a vehicle gas generating composition.

The amount of the fuel component in the gas generating composition 16 is that amount necessary to achieve sustained combustion of the gas generating composition. This amount can vary depending upon the particular fuel involved and other reactants. A preferred amount of the fuel component is that amount necessary to achieve an oxygen balance with the oxidizer which upon combustion produces essentially carbon dioxide, nitrogen, and water. This can be characterized as complete combustion of the fuel component. Preferably, the amount of the fuel component is in the range of about 74% to about 90% by weight based on the combined weight of the fuel component and oxidizer.

The oxidizer in the gas generating composition of the present invention can be any inorganic oxidizer salt commonly used in a vehicle occupant protection device. A preferred oxidizer is selected from the group consisting of ammonium nitrate (AN), potassium nitrate (KN), sodium nitrate (NaN), potassium perchlorate (KP), ammonium perchlorate (AP), and combinations thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount which is effective to minimize the volumetric and structural changes associated with phase transitions inherent to pure ammonium nitrate. A preferred phase stabilizer is potassium nitrate. Other useful phase stabilizers include potassium salts such as potassium dichromate, potassium oxalate, and mixtures thereof. Ammonium nitrate can also be stabilized by doping with copper and zinc ions. Other compounds, modifiers, and methods that are effective to phase stabilize ammonium nitrate are well known and suitable in the present invention.

The amount of oxidizer in the gas generating composition is that amount necessary to achieve sustained combustion of the gas generating composition. A preferred amount of oxidizer is in the range of about 10% to about 26% by weight based on the combined weight of the oxidizer and the fuel component. A preferred ratio of fuel component to oxidizer is about 3:1 or greater.

The gas generating composition of the present invention preferably comprises an elastomeric binder. Suitable binders for gas generating compositions are well known in the art. Preferred binders include polycarbonates, polyurethanes, polyesters, polyethers, polysuccinates, thermoplastic rubbers, polybutadiene, polystyrene, and mixtures thereof.

A preferred amount of binder is in the range of 0 to about 10% by weight based on the weight of the gas generating composition. More preferably the amount of binder is in the range of about 2.5% to about 10% by weight based on the weight of the gas generating composition.

The gas generating composition may comprise a coolant. A preferred coolant is a metal oxide such as aluminum oxide ($Al_2O_3$). Metal oxides also act as sinter forming materials which bind to and form solid residue with caustic materials that may be generated upon combustion of the gas generating composition. The solid residue so formed is more easily filtered in the vehicle occupant protection device during inflation. The coolant may be present in the range of about 10% to about 25% by weight based on the weight of the gas generating composition.

The present invention may also comprise other ingredients commonly added to a gas generating composition for providing inflation gas for inflating an inflatable vehicle occupant protection device, such as plasticizers, process aids, burn rate modifiers, and ignition aids, all in relatively small amounts.

EXAMPLE 1

A gas generating composition is prepared by combining, in a conventional powder mixing device, powdered 2-oxo-1,3,5-trinitro-1,3,5-triazacyclohexane (keto-RDX) and powdered reagent grade ammonium nitrate (AN) in a weight ratio of about 3:1. Prior to mixing, the powders are passed through a fifty mesh screen. The weight ratio of about 3:1 is selected for substantially complete combustion of the gas generating composition to a gas consisting essentially of carbon dioxide, nitrogen, and water.

After combining the keto-RDX and AN, the mixture of keto-RDX and AN is compacted under a compaction pressure of 11,000 ft-lb (1521 kg-m) into tablets having a diameter of approximately 1.3 cm, a thickness of 0.73 cm, and a density of 1.927 g/cm$^3$.

Thermochemical calculations for the combustion of tablets of the gas generating material were performed using an initial combustion temperature of 298K, a chamber pressure of 2000 psi and an exhaust pressure of 14.7 psi. The thermochemical calculation results are given in Table 1.

TABLE 1

| | |
|---|---|
| keto-RDX wt % | 74.68 |
| AN wt % | 25.32 |
| T flame, K | 3167 |
| T exhaust, K | 1689 |
| Residue, g/100 g | 0 |
| Impetus, lbfts/lbm | 388,600 |
| Water wt % | 22.8 |

Example 1 contains by weight of the gas generating composition 74.68% 2-oxo-1,3,5-trinitro-1,3,5-triazacyclohexane (keto-RDX) and 25.32% ammonium nitrate (AN). The flame temperature, exhaust temperature, amount of residue produced, and impetus are all within acceptable performance specifications for gas generating compositions used in a vehicle occupant apparatus.

COMPARATIVE EXAMPLE 1

A gas generating composition was prepared comprising 1,3,5-trinitro-1,3,5-triazacyclohexane (RDX) and reagent grade ammonium nitrate (AN) in the weight ratio of about 6:4. This ratio was selected for substantially complete combustion of the fuel component to a gas consisting essentially of carbon dioxide, nitrogen, and water.

The RDX and AN are prepared separately as powders, screened, mixed, and compacted into tablets as in Example 1. Results for the combustion of the tablets are listed in the following Table 2 along with results of Example 1 for purposes of comparison.

TABLE 2

| | Comp. EX 1 | EX 1 |
|---|---|---|
| RDX wt % | 55 | — |
| keto-RDX wt % | — | 74.68 |
| AN wt % | 45 | 25.32 |
| Residue, g/100 g | 0 | 0 |
| Water wt % | 35 | 22.8 |

Table 2 shows that the keto-RDX and AN composition requires substantially less ammonium nitrate for complete combustion than the RDX and AN composition, 25% compared to 40%, reducing the adverse affect that ammonium nitrate can have on the composition. Furthermore, the keto-RDX and AN composition produced substantially less water upon combustion than the RDX and AN composition.

The reduction of water produced upon combustion is significant. Water produced upon combustion is in the form of water vapor. Air bag inflators must operate effectively over a temperature range from −40° C. to 100° C. When the inflator is at −40° C. there is a tendency for water vapor to condense on the cooler metal surfaces of the inflator so that the volume of the inflation gas that passes to the vehicle occupant protection device is reduced, which may lead, to under-inflation of the vehicle occupant protection device. In addition, water vapor condensing on the vehicle occupant protection device's surfaces may give up heat of condensation to the vehicle occupant protection device.

EXAMPLE 2

A gas generating composition is prepared comprising 2-oxo-1,3,5-trinitro-1,3,5-triazacyclohexane (keto-RDX) and potassium perchlorate (KP) in the weight ratio of 7:1. This ratio is selected for substantially complete combustion of the fuel component to a gas consisting essentially of carbon dioxide, nitrogen, and water.

The keto-RDX and the KP are prepared separately as powders, screened, mixed, and compacted into tablets as in Example 1. The thermochemical calculation results are listed in the following Table 3.

TABLE 3

| | |
|---|---|
| keto-RDX wt % | 87.2 |
| KP wt % | 12.8 |
| T flame, K | 3381 |
| T exhaust, K | 2006 |
| Residue, g/100 g | 6.88 |
| Impetus, lbfts/lbm | 378,800 |
| Water wt % | 16.6 |

Example 2 contains by weight of the gas generating composition 87.2% 2-oxo-1,3,5-trinitro-1,3,5-triazacyclohexane (keto-RDX) and 12.8% potassium perchlorate (KP). The flame temperature, exhaust temperature, amount of residue produced, and impetus are all within acceptable performance specifications for gas generating compositions used in a vehicle occupant protection apparatus.

COMPARATIVE EXAMPLE 2

A gas generating composition was prepared comprising 1,3,5-trinitro-1,3,5-triazacyclohexane (RDX) and potassium perchlorate (KP) in the weight ratio of about 6:4. This ratio was selected for substantially complete combustion of the fuel component to a gas consisting essentially of carbon dioxide, nitrogen, and water.

The RDX and AN are prepared separately as powders, screened, mixed, and compacted into tablets as in Example 1. Results for the combustion of the tablets are listed in the following Table 4 along with the results of Example 1 for purposes of comparison.

TABLE 4

| | Comp. EX 2 | EX 2 |
|---|---|---|
| RDX wt % | 68.1 | — |
| keto-RDX wt % | — | 87.21 |
| KP wt % | 31.9 | 12.79 |
| Residue, g/100 g | 17.2 | 6.88 |
| Water wt % | 55 | 36 |

Table 4 shows that the keto-RDX and KP composition produces substantially less residue than the RDX and KP composition, 6.88 grams as compared to 17.2 grams per 100 grams of gas generating composition. The amount of residue produced by the keto-RDX and KP composition is very small and well below performance specifications for gas generating compositions used in a vehicle occupant protection device. Additionally, the keto-RDX and potassium perchlorate composition produces less water vapor than the RDX and potassium perchlorate composition.

EXAMPLES 3–12

In Examples 3–6 the fuel component is 2-oxo-1,3,5-trinitro-1,3,5-triazacyclohexane (keto-RDX) and the oxidizers are, respectively, potassium nitrate (KN) (Example 3), ammonium nitrate (AN) phase stabilized with 15% potassium nitrate (KN) (Example 4), ammonium nitrate (AN) phase stabilized with 10% potassium nitrate (KN) and potassium perchlorate (KP) (Example 5), and ammonium perchlorate (AP) mixed with sodium nitrate (NaN) (Example 6). The formulations and combustion results are given in Table 5.

In Examples 7-12 the fuel component is 2-oxo-1,3,5-trinitro-1,3,5-triazacyclohexane (keto-RDX) and the oxidizers are, respectively, ammonium nitrate (AN) (Example 7), potassium perchlorate (KP) (Example 8), potassium nitrate (KN) (Example 9), ammonium nitrate (AN) phase stabilized with 15% potassium nitrate (KN) (Example 10), ammonium nitrate (AN) phase stabilized with 10% potassium nitrate (KN) and potassium perchlorate (KP) (Example 11), and ammonium perchlorate (AP) mixed with sodium nitrate (NaN) (Example 12). Aluminum oxide ($Al_2O_3$) has been added to the respective compositions as a coolant to reduce the combustion and exhaust temperature. The formulations and combustion results are given in Table 6.

TABLE 5

| | EX 3 | EX 4 | EX 5 | EX 6 |
|---|---|---|---|---|
| keto-RDX wt % | 85.38 | 77.23 | 78.04 | 85.4 |
| AN wt % | — | 19.36 | 19.11 | — |
| KN wt % | 14.62 | 3.41 | 1.76 | — |
| NaN wt % | — | — | — | 6.13 |
| AP wt % | — | — | — | 8.47 |

TABLE 5-continued

| | EX 3 | EX 4 | EX 5 | EX 6 |
|---|---|---|---|---|
| KP wt % | — | — | 1.10 | — |
| T flame, K | 3261 | 3190 | 3209 | 3324 |
| T exhaust, K | 1846 | 1726 | 1743 | 1935 |
| Residue, g/100 g | 14.48 | 3.37 | 2.34 | 3.86 |
| Impetus, lbfts/lbm | 357,900 | 302,600 | 386,600 | 383,778 |

TABLE 6

| | EX 7 | EX 8 | EX 9 | EX 10 | EX 11 | EX 12 |
|---|---|---|---|---|---|---|
| keto-RDX wt % | 56.02 | 65.38 | 64.01 | 58.07 | 58.68 | 68.3 |
| AN wt % | 19.09 | — | — | 14.56 | 14.37 | — |
| KN wt % | — | — | 10.99 | 2.56 | 1.32 | — |
| NaN wt % | — | — | — | — | — | 4.90 |
| AP wt % | — | — | — | — | — | 6.77 |
| KP wt % | — | 9.62 | — | — | 0.83 | — |
| $Al_2O_3$ wt % | 24.9 | 25 | 25 | 24.8 | 24.8 | 25 |
| T flame, K | 2692 | 2904 | 2762 | 2717 | 2737 | 2857 |
| T exhaust, K | 1587 | 1866 | 1716 | 1620 | 1633 | 1804 |
| Residue, g/100 g | 24.9 | 30.2 | 35.9 | 27.3 | 26.6 | 29.66 |
| Impetus, lbfts/lbm | 329,400 | 319,300 | 300,000 | 323,800 | 327,500 | 325,307 |

Referring to Table 5, Example 3 contains by weight of the gas generating composition 85.38% 2-oxo-1,3,5-trinitro-1,3,5-triazacyclohexane (keto-RDX) and 14.62% potassium nitrate (KN) for substantially complete combustion of the carbon atoms in 2-oxo-1,3,5-trinitro-1,3,5-triazacyclohexane to carbon dioxide. The flame temperature, exhaust temperature, amount of residue produced, and impetus are all within acceptable performance specifications for gas generating compositions used in vehicle occupant protection devices.

Example 4 contains by weight of the gas generating composition 77.23% 2-oxo-1,3,5-trinitro-1,3,5-triazacyclohexane (keto-RDX), 19.36% ammonium nitrate (AN), phase stabilized with 3.41% potassium nitrate (KN), for substantially complete combustion of the carbon atoms in 2-oxo-1,3,5-trinitro-1,3,5-triazacyclohexane to carbon dioxide. The flame temperature, exhaust temperature, amount of residue produced, and impetus are all within acceptable performance specifications for gas generating compositions used in vehicle occupant protection devices.

Example 5 contains by weight of the gas generating composition 78.04% 2-oxo-1,3,5-trinitro-1,3,5-triazacyclohexane (keto-RDX), 19.11% ammonium nitrate (AN), phase stabilized with 1.76% potassium nitrate (KN), and 1.10% potassium perchlorate (KP) for substantially complete combustion of the carbon atoms in 2-oxo-1,3,5-trinitro-1,3,5-triazacyclohexane to carbon dioxide. The flame temperature, exhaust temperature, amount of residue produced, and impetus are all within acceptable performance specifications for gas generating compositions used in vehicle occupant protection apparatuses.

Example 6 contains by weight of the gas generating composition 85.4% 2-oxo-1,3,5-trinitro-1,3,5-triazacyclohexane (keto-RDX), 8.47% ammonium perchlorate (AP) mixed with 6.13% sodium nitrate (NaN) for substantially complete combustion of the carbon atoms in 2-oxo-1,3,5-trinitro-1,3,5-triazacyclohexane to carbon dioxide. The flame temperature, exhaust temperature, amount of residue produced, and impetus are all within acceptable performance specifications for gas generating compositions used in vehicle occupant protection apparatuses.

Similar results are obtained in Table 6, Examples 7–12, where aluminum oxide ($Al_2O_3$) has been added to the gas generating compositions as a coolant and a sinter forming material. The exhaust temperatures of the gas generated upon combustion in Examples 7–12 are reduced at least about 100° C. as compared to the exhaust temperatures of the gas generated upon combustion in Examples 1–6, which do not contain the aluminum oxide. The amounts of residue produced by the gas generating compositions of Examples 7–12 are substantially increased in comparison to the amounts of residue produced by the gas generating compositions of Examples 1–6. Nonetheless, as a result of the addition of aluminum oxide, the residue produced from the gas generating compositions of Examples 7–12 is a solid which is more easily filterable in a vehicle occupant protection device. Thus, the gas generating compositions of Examples 7–12 are within acceptable performance specifications for gas generating compositions used in vehicle occupant protection apparatuses.

None of the Examples includes a binder component. In actual practice, a gas generating composition useful for a vehicle occupant protection device will preferably comprise a binder to maintain the integrity of a body of the generating composition. A binder would be selected which would not materially affect the combustion results shown in the tables.

Advantages of the present invention should now be apparent. Primarily the present invention takes advantage of the favorable performance characteristics of using a keto derivative of RDX or HMX. More specifically, the present invention uses a fuel component selected from the group consisting of 2-oxo-1,3,5-trinitro-1,3,5-triazacyclohexane (keto-RDX), 2,4-dioxo-1,3,5-trinitro-1,3,5-triazacyclohexane (di-keto-RDX), 2,4,6-trioxo-1,3,5-trinitro-1,3,5-triazacyclohexane (tri-keto-RDX), 2-oxo-1,3,5,7-tetranitro-1,3,5,7-tetrazacyclooctane (keto-HMX), 2,4-dioxo-1,3,5,7-tetranitro-1,3,5,7-tetracyclooctane (di-keto-HMX), 2,4,6-trioxo-1,3,5,7-tetranitro-1,3,5,7-tetracyclooctane (tri-keto-HMX), and 2,4,6,8-tetraoxo-1,3,5,7-tetranitro-1,3,5,7-tetracyclooctane (tetra-keto-HMX) with an inorganic salt as an oxidizer. A mixture of the oxidizer and the claimed fuel component offers improved mechanical stability without sacrificing chemical stability. Furthermore, the gas generating composition of the present invention produces an improved gas product which is essentially non-toxic and free of particulates and which has a substantial reduction in water vapor. The improvements in mechanical stability and quality of the gas product accrue from the use of less oxidizer for complete combustion of the fuel component and from the use of a fuel component that contains a minimal amount of hydrogen.

From the above description of the invention, those skilled in the art will perceive improvements, changes, and modifications. Such improvements, changes and modifications within the skill of the art are intended to be covered by the appended claims.

Having described the invention, the following is claimed:

1. An apparatus comprising an inflatable vehicle occupant protection device and a gas generating composition which when ignited produces gas to inflate said inflatable vehicle occupant protection device, said gas generating composition comprising an oxidizer, and a fuel component, wherein said oxidizer is an inorganic salt and said fuel component is selected from the group consisting of 2-oxo-1,3,5-trinitro-1,3,5-triazacyclohexane, 2,4-dioxo-1,3,5-trinitro-1,3,5-triazacyclohexane, 2,4,6-trioxo-1,3,5-trinitro-1,3,5-triazacyclohexane, 2-oxo-1,3,5,7-tetranitro-1,3,5,7-tetrazacyclooctane, 2,4-dioxo-1,3,5,7-tetranitro-1,3,5,7-tetracyclooctane, 2,4,6-trioxo-1,3,5,7-tetranitro-1,3,5,7-tetracyclooctane, and 2,4,6,8-tetraoxo-1,3,5,7-tetranitro-1,3,5,7-tetracyclooctane.

2. The apparatus as defined in claim 1 wherein said oxidizer is selected from the group consisting of ammonium nitrate, potassium nitrate, potassium perchlorate, and ammonium perchlorate and combinations thereof.

3. The apparatus as defined in claim 2 wherein said oxidizer is ammonium nitrate and said ammonium nitrate is phase stabilized.

4. The apparatus as defined in claim 1 wherein the gas generating composition further comprises a coolant.

5. The apparatus as defined in claim 4 wherein said coolant is aluminum oxide.

6. The apparatus as defined in claim 1 wherein the gas generating composition further comprises a binder.

7. The apparatus as defined in claim 1 wherein the amount of fuel component is about 74% to about 90% by weight of the combined weight of said fuel component and said oxidizer.

8. The apparatus as defined in claim 1 wherein the amount of oxidizer is about 10% to about 26% by weight of the combined weight of said fuel component and said oxidizer.

9. An apparatus comprising an inflatable vehicle occupant protection device and a gas generating composition which when ignited produces gas to inflate said inflatable vehicle occupant protection device, said gas generating composition comprising an oxidizer, and a fuel component, wherein said oxidizer is selected from the group consisting of ammonium nitrate, potassium nitrate, potassium perchlorate, and ammonium perchlorate and wherein said fuel component is 2-oxo-1,3,5-trinitro-1,3,5-triazacyclohexane.

* * * * *